United States Patent [19]

Lesslie et al.

[11] Patent Number: 5,027,091

[45] Date of Patent: Jun. 25, 1991

[54] MOLDED CASE CIRCUIT INTERRUPTER RATING PLUG KEYING AND INTERLOCK ARRANGEMENT

[75] Inventors: David J. Lesslie, Plainville; Robert A. Morris, Burlington; Alan J. Messerli, Bristol; Graham A. Scott, Avon, all of Conn.; Alexander A. Krajewski, East Hampton, all of Conn.

[73] Assignee: General Electric Company, New York, N.Y.

[21] Appl. No.: 310,180

[22] Filed: Feb. 15, 1989

[51] Int. Cl.[5] ..... H01H 67/02

[52] U.S. Cl. ..... 335/132; 335/202

[58] Field of Search ..... 335/6, 131, 132, 202, 335/13; 200/293, 303; 337/187, 198

[56] References Cited

U.S. PATENT DOCUMENTS 3,826,951 7/1974 Mater et al. .

4,081,779 3/1978 Ranzaigo ..... 337/198

4,181,906 1/1980 Matsko et al. .

4,622,444 11/1986 Kandatsu ..... 335/132

4,728,914 3/1988 Morris et al. .

4,754,247 6/1988 Raymont et al. .

*Primary Examiner*—Leo P. Picard

*Assistant Examiner*—Lincoln Donovan

*Attorney, Agent, or Firm*—Richard A. Menelly; Walter C. Bernkopf; Fred Jacob

[57] ABSTRACT

An electronic circuit interrupter includes an electronic trip circuit contained within a circuit interrupter enclosure along with an externally accessible rating plug for setting the ampere rating. The rating plug includes keying tabs that fit within corresponding keying slots formed on the top surface of the electronic circuit interrupter enclosure. Interlock is provided between the rating plug and the electric panelboard which includes a plurality of electronic circuit interrupters connected within an industrial power system. Tabs formed on the side walls of the rating plug are trapped under the panelboard face plate to prevent removal of the rating plug without first removing the panelboard face plate.

5 Claims, 5 Drawing Sheets

MOLDED CASE CIRCUIT INTERRUPTER RATING PLUG KEYING AND INTERLOCK ARRANGEMENT

BACKGROUND OF THE INVENTION

Electronic trip circuit interrupters are designed to interrupt overcurrent conditions over a wide range of ampere ratings. The current through the protected electric power circuit is continuously sensed by means of current transformers and a voltage signal is supplied to the signal processor within the electronic trip unit circuit by means of so-called "burden resistors". The size of the burden resistor accordingly sets the ampere rating of the corresponding circuit interrupter. A common electronic circuit interrupter could therefore operate over a wide range of ampere ratings by merely changing the value of the burden resistor within the electronic trip circuit. U.S. Pat. No. 4,728,914 entitled "Rating Plug Enclosure for Molded Case Circuit Breakers" describes a particular rating plug that is used to vary the ampere rating of electronic circuit interrupters over several hundred amperes. It is important to prevent an electronic circuit interrupter from being inserted within an electrical distribution circuit for which the circuit interrupter is over-rated. It is perhaps equally important not to insert a circuit interrupter within an electric power distribution circuit for which the circuit interrupter is under-rated, as so-called "nuisance-tripping" could occur. It is also important to insure that a circuit interrupter is not inserted within an electric power distribution circuit with no rating plug or burden resistor whatsoever. U.S. Pat. Nos. 3,826,951 and 4,181,906 describe arrangements whereby an improper rating plug is prevented from being inadvertently inserted within an electronic circuit interrupter as well as preventing the removal of the rating plug after the electronic circuit interrupter is installed within an electric power distribution circuit.

U.S. Pat. No. 4,754,247 describes an integrated protection unit which includes basic overcurrent protection along with selected accessory features all contained within the circuit interrupter enclosure. An accessory cover allows field-installation of the selected accessories along with the installation of the electronic trip unit rating plug. The Patent further describes means for interlocking the accessory cover to prevent removal of the accessories from the circuit interrupter once the circuit interrupter is inserted within a load center or panelboard enclosure. All of the aforementioned U.S. Patents are incorporated herein and should be reviewed for their respective teachings.

One purpose of this invention is to provide an arrangement whereby the rating plug described within aforementioned U.S. Pat. No. 4,728,914 is keyed to the proper electric circuit interrupter enclosure and is interlocked with the load center or panelboard within which the electronic circuit interrupter is installed.

SUMMARY OF THE INVENTION

A replaceable rating plug is provided with keying means which cooperates with an electronic circuit interrupter accessory cover for insuring the insertion of the proper rating plug within the electronic circuit interrupter. The rating plug further includes interlock tabs to prevent the removal of the rating plug from the load center or panelboard after the circuit interrupter is electrically connected therein.

DESCRIPTION OF THE PREFERRED EMBODIMENT

Figure 1:
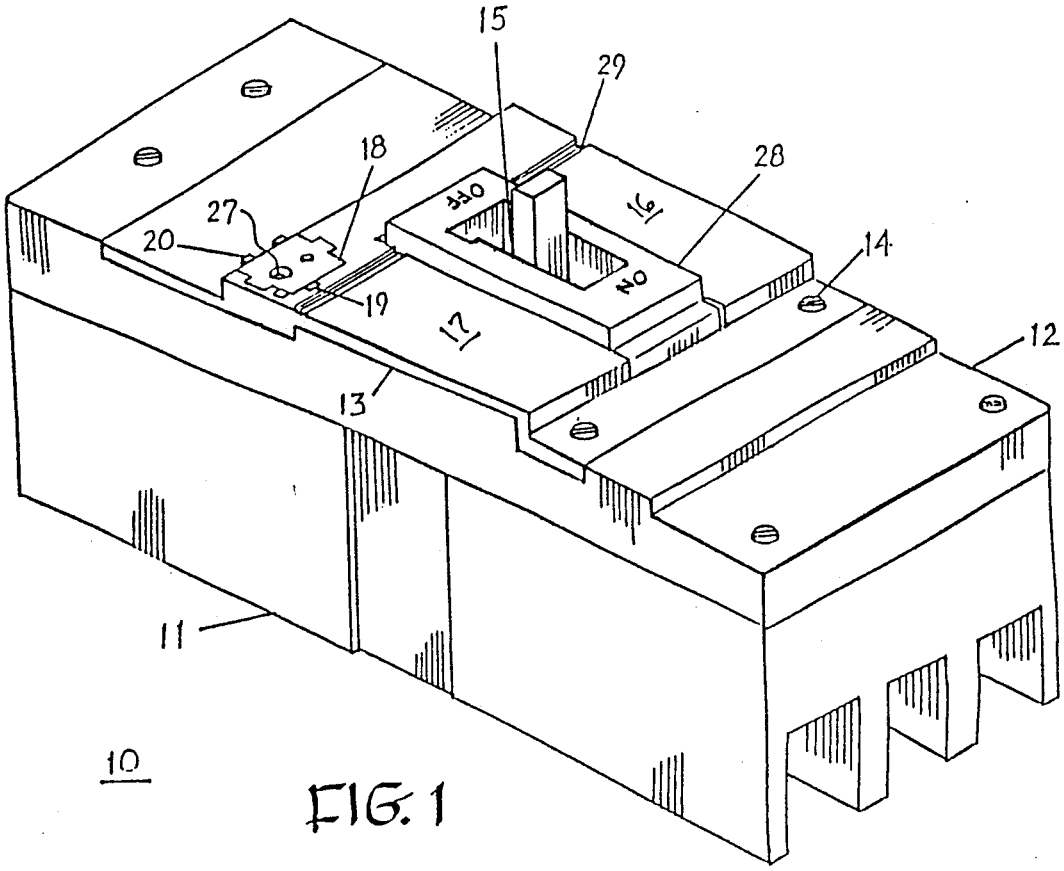
FIG. 1 is a top perspective view of an electronic circuit interrupter which includes the keyed rating plug in accordance with the invention.

An electronic circuit interrupter 10 such as that described within the aforementioned U.S. Pat. No. 4,754,247 is shown in FIG. 1 and consists of a molded plastic circuit interrupter case 11 to which a corresponding molded plastic cover 12 is attached. The cover is shaped to include an accessory cover 13 which is attached to the circuit interrupter cover by means of screws 14 and is rotated to an open position by means of an accessory cover hinge 29. The accessory cover includes an actuator-accessory door 16 and an auxiliary switch door 17. A compartment is formed within the accessory cover for receiving a rating plug 18 such as described within aforementioned U.S. Pat. No. 4,728,914. The rating plug sets the ampere rating of the electronic circuit interrupter and includes a test jack opening 27 to insure the proper operation of the electronic trip circuit contained within the circuit interrupter cover 12. The rating plug includes keying tabs 19 to insure that the correct rating plug is inserted within the electronic circuit interrupter. The rating plug further includes interlock tabs 20 which prevent the removal of the rating plug once the circuit interrupter is electrically connected within a load center or panelboard enclosure.

Figure 2:
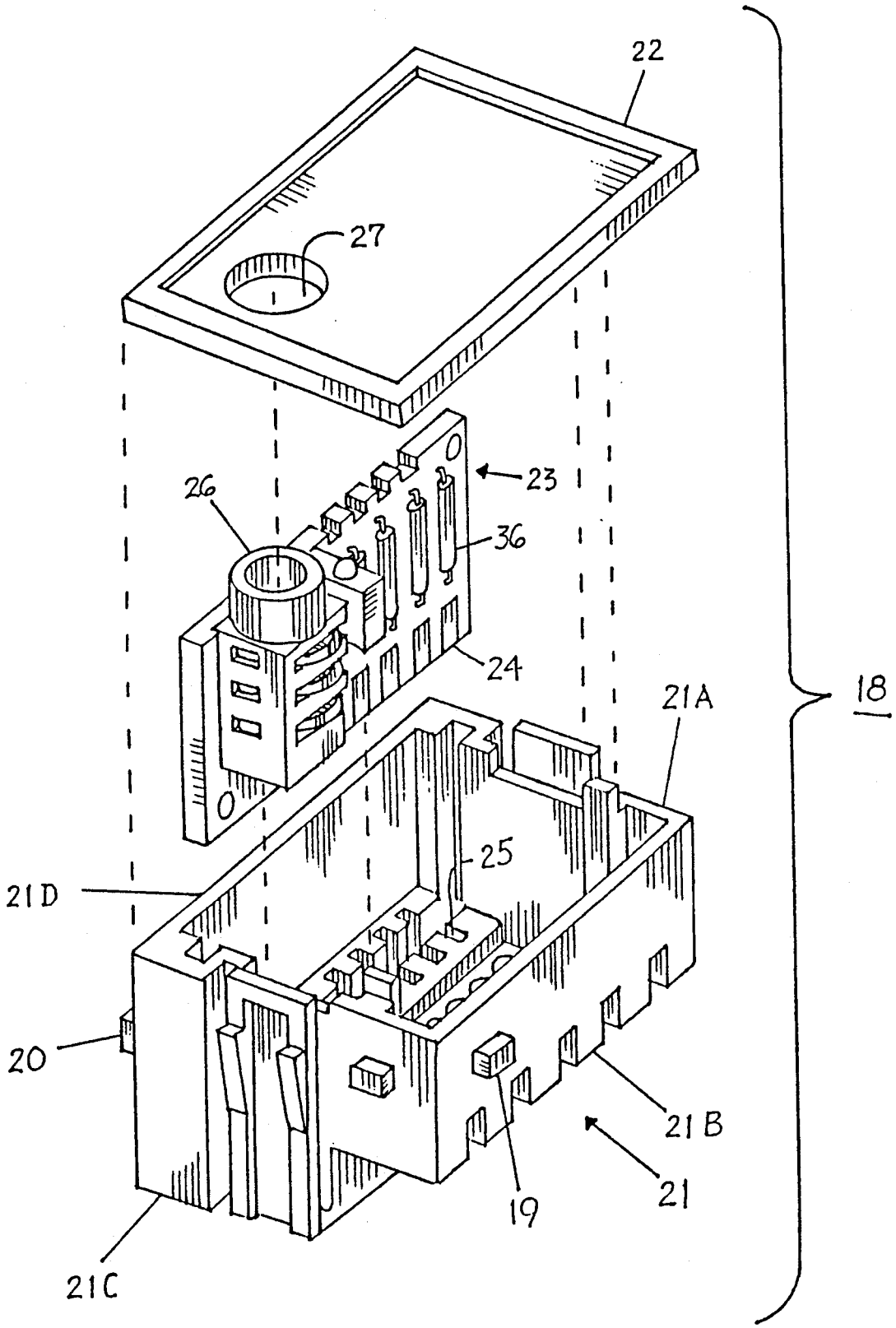
FIG. 2 is a top perspective view in isometric projection, of the keyed rating plug depicted in FIG. 1.

The structure of the rating plug is best seen by now referring to FIG. 2 wherein the rating plug 18 is depicted prior to assembly of the printed wire board 23 within the rating plug case 21 and the attachment of the rating plug cover 22 to the rating plug case. The test jack 26 is assembled beneath the test jack opening 27 for external access to the test jack while the electrical contact pads 24 extend down through the slotted openings 25 formed on the bottom of the rating plug case to provide external electrical connection with the printed wiring board and the burden resistors 36 connected with the printed wire board. One or more keying tabs 19 are integrally-formed along three sides, 21A–21C of the outside perimeter of the rating plug case. One or more interlock tabs 20 are formed along the outside perimeter of the remaining side 21D.

Figure 3:
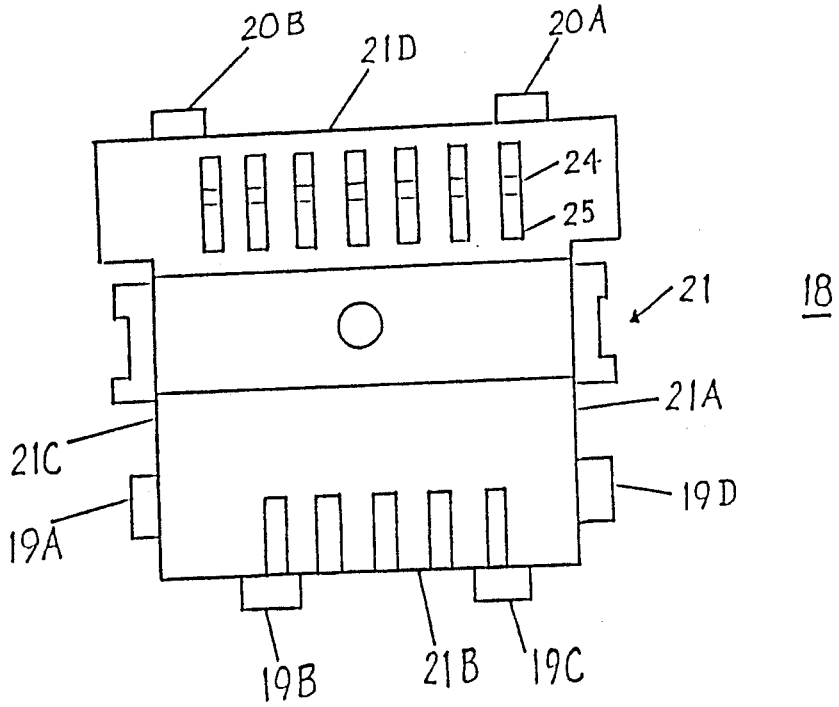
FIG. 3 is a bottom plan view of the assembled rating plug depicted in FIG. 2.

The arrangement of the keying tabs 19A–19D on the sides 21A–21C of the rating plug case 21 is shown in FIG. 3. Side 21B faces toward the operating handle 15 of the electronic circuit interrupter (FIG. 1) while the side 21D faces away from the circuit interrupter operating handle. The interlock tabs 20A, 20B are integrally-formed on the side 21D facing away from the circuit breaker operating handle.

Figure 4:
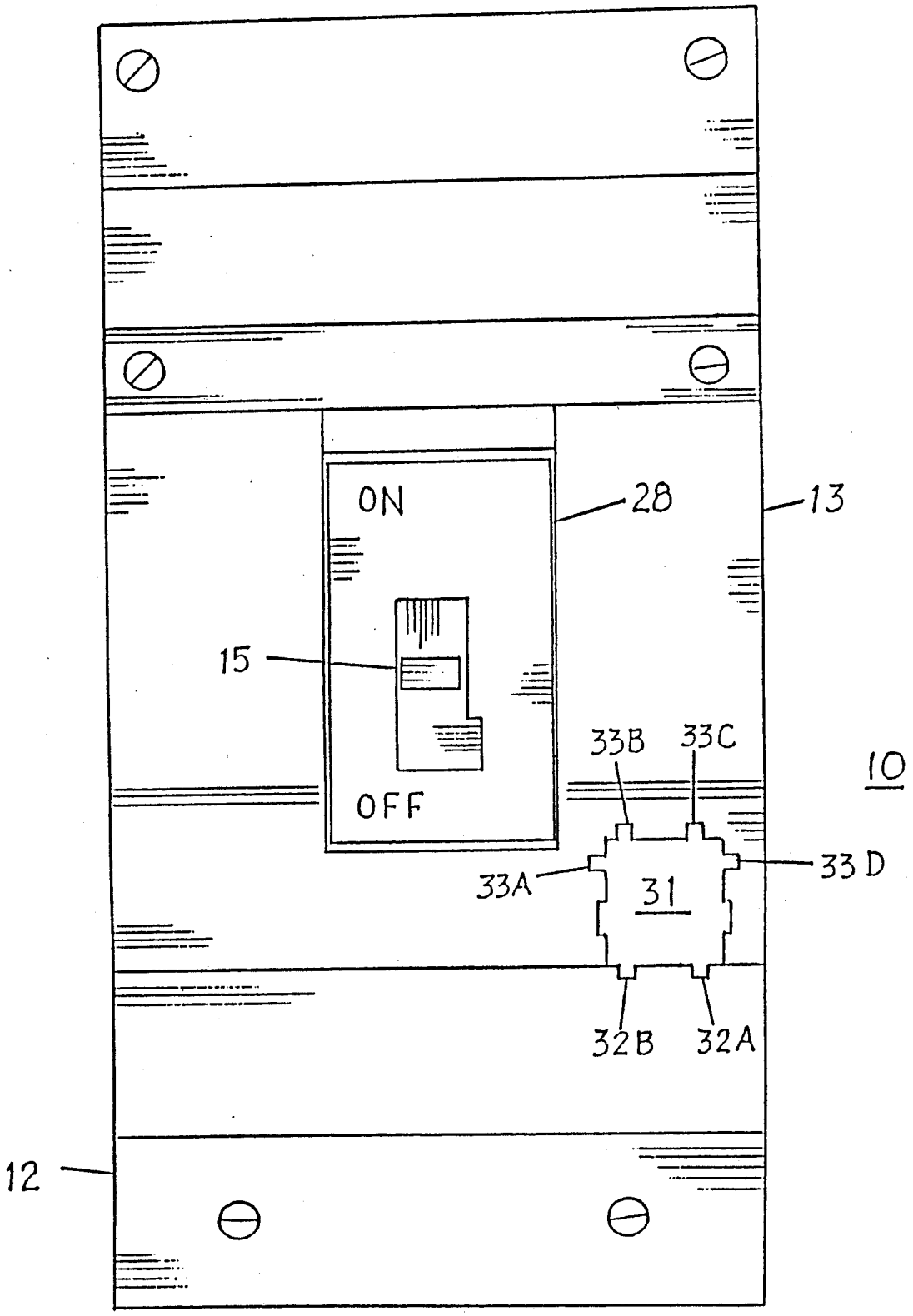
FIG. 4 is a plan view of the circuit interrupter of FIG. 1 with the keyed rating plug removed to show the rating plug recess.

The keying function of the rating plug is best seen by referring now to FIG. 4 wherein the circuit interrupter 10 is viewed such that the interrupter cover 12 and accessory cover 13 are depicted with the operating handle 15 and cover escutcheon 28 extend upwards from the plane of the page away from the top surface of the accessory cover 13. The rating plug recess 31 is formed within the accessory cover and includes corresponding interlock slots 32A, 32B which receive the interlock tabs 20A, 20B of FIG. 3 when the rating plug is inserted within the recess. To insure that the proper rating plug is inserted within the corresponding circuit interrupter, recess slots 33A–33D are formed within the accessory cover 13. By referring to both FIGS. 3 and 4, it is seen that the number of keying tabs can accordingly be made to correspond with the number of recess slots. For example, a 100 ampere rated circuit interrupter could have a single integrally-formed tab 19A whereas the remaining tabs 19B–19D are removed and the rating plug recess 31 would then correspondingly include recess slot 33A and the remaining slots 33C–33D could be plugged. A 200 ampere rating plug could have keying tabs 19A, 19B to correspond with the keying slots 33A, 33C or alternatively a 200 ampere rating plug could only have keying tab 19B and the remaining tabs 19A, 19C and 19D could be removed and the recess slot would accordingly have a corresponding keying slot 33B with the remaining slots 33A, 33C, 33D plugged. For increased reliability, two keying tabs are preferred since one keying tab could possibly be placed within better of two or more keying slots.

Figure 5:
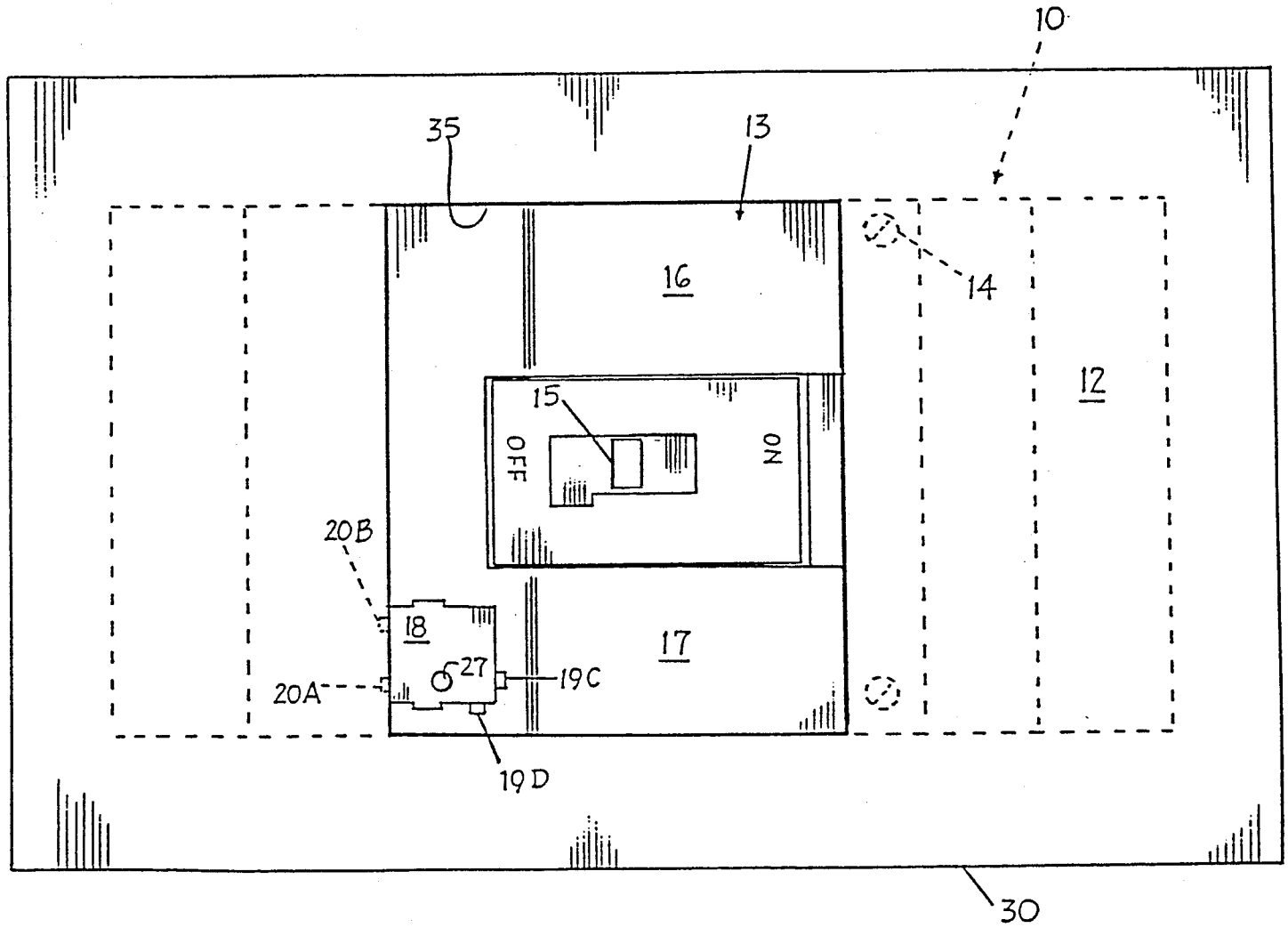
FIG. 5 is a plan view of the circuit interrupter of FIG. 1 mounted within an electric panelboard enclosure.
Figure 6:
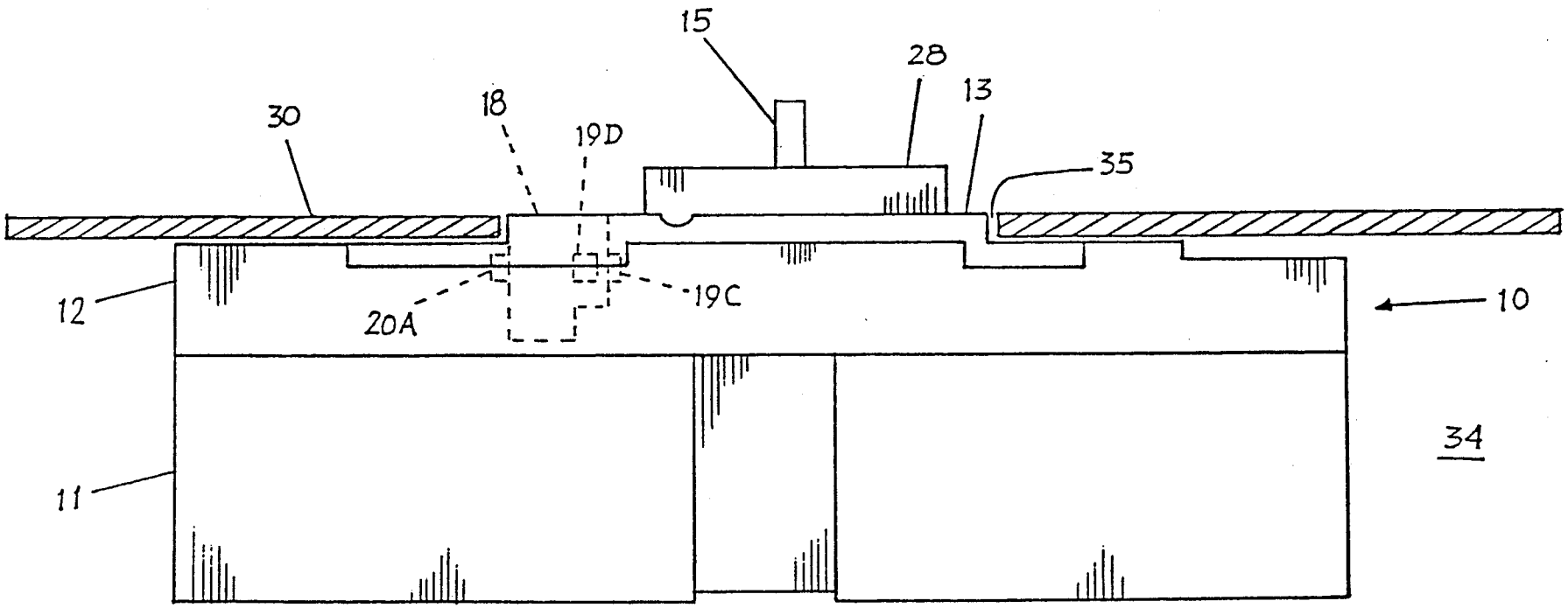
FIG. 6 is a side view in partial section of the panelboard enclosure depicted in FIG. 5.

The interlock function of the rating plug is best seen by referring to FIGS. 3, 5 and 6. In FIG. 5, an electric panelboard 34 is depicted with a single electronic circuit interrupter 10 arranged under the panelboard face plate 30. The screws 14 that fasten the accessory cover 13 to the circuit breaker cover 12 are trapped beneath the panelboard front plate 30 such that the actuator-accessory door 16 and auxiliary switch accessory door 17 cannot be opened without first removing the panelboard face plate. In a similar manner, the interlock tabs 20A, 20B extending from the rating plug 18 are also trapped under the panelboard face plate which thereby prevents the rating plug from being removed without first removing the panelboard front plate. The keying tabs 19C, 19D are readily viewable from the front of the electric panelboard and the test jack opening 27 is externally accessible along with the operating handle 15. The positioning of the keying tabs 19C and 19D within the circuit breaker cover shown in FIG. 6 wherein one of the interlock tabs 20A on the rating plug 18 is shown positioned under the panelboard front plate 30. Part of the accessory cover 13 is also shown trapped under the panelboard front plate while the cover escutcheon 28 that carries the operating handle 15 extends upward through slot 35 defined within the front plate. A molded plastic rating plug or electronic circuit interrupter is herein described having both keying tabs as well as interlock tabs integrally-formed therein. The keying tabs insure that the proper rating plug is inserted within the corresponding electronic circuit interrupter while the interlock tabs prevent the rating plug from being removed from the electronic circuit interrupter when the circuit interrupter is electrically connected within an electric panelboard enclosure.

Having thus described our invention, what we claim as new and desire to secure by Letters Patent is:

1. An electronic trip circuit interrupter comprising in combination:

a circuit interrupter cover and case;

an electronic trip circuit within said interrupter cover and arranged for interrupting circuit current through separable contacts arranged within said interrupter case; and a circuit interrupter cover attached to said interrupter case and containing first recesses formed therein for accepting an actuator-accessory unit and accessories, said circuit interrupter cover further containing a second recess formed therein for accepting a rating plug to set the circuit interrupter ampere rating, said second recess including keying means formed therein to prevent insertion of any said rating plug having an improper rating, said second recess including interlock means formed therein to prevent removal of said rating plug from said second recess when said circuit interrupter is installed within an electrical enclosure.

2. The electronic trip circuit interrupter of claim 1 wherein said second recess includes a four-sided perimeter and said keying means comprises keying slots formed within three of said four sides.

3. The electronic trip circuit interrupter of claim 2 wherein said interlock means comprises interlock slots formed within said one of said four sides.

4. The electronic trip circuit interrupter of claim 1 wherein said circuit interrupter further includes an operating handle extending from said interrupter cover, said keying slots being arranged proximate said operating handle and said interlock slots being arranged distal said operating handle.

5. An electrical circuit interrupter enclosure comprising in combination;

an electric circuit interrupter including a circuit-interrupter cover attached to a top surface, said accessory cover including a rating plug recess containing a rating plug;

an apertured face plate arranged over said circuit interrupter, a first part of said accessory cover being accessible through said face plate aperture; and interlock tabs extending from said rating plug within said rating plug recess and underlying said face plate; said face plate thereby interfering with removal of said rating plug from said rating plug recess.

* * * * *